US008620200B2

(12) United States Patent
Doi

(10) Patent No.: US 8,620,200 B2
(45) Date of Patent: Dec. 31, 2013

(54) IMAGE FORMING APPARATUS AND CONTROL METHOD

(75) Inventor: Yohei Doi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 372 days.

(21) Appl. No.: 13/015,075

(22) Filed: Jan. 27, 2011

(65) Prior Publication Data

US 2011/0188873 A1 Aug. 4, 2011

Related U.S. Application Data

(60) Provisional application No. 61/300,169, filed on Feb. 1, 2010.

(51) Int. Cl.
*G03G 15/20* (2006.01)

(52) U.S. Cl.
USPC ..... 399/328

(58) Field of Classification Search
USPC ..... 399/67, 320, 328, 329, 330; 219/216
See application file for complete search history.

(56) References Cited

U.S. PATENT DOCUMENTS

| | | | | |
|---|---|---|---|---|
| 6,901,235 | B2 | 5/2005 | Shimizu et al. | |
| 7,359,667 | B2 * | 4/2008 | Kwak et al. | 399/330 |
| 2009/0245902 | A1 | 10/2009 | Gon et al. | |

* cited by examiner

*Primary Examiner* — David Gray
*Assistant Examiner* — Erika J Villaluna
(74) *Attorney, Agent, or Firm* — Turocy & Watson, LLP

(57) ABSTRACT

Certain embodiments provide an image forming device including: a print portion; a first roller provided in a sheet transportation direction; a heating element provided in either the first roller or an endless belt wound around the first roller and generates heat by magnetic flux; a second roller that forms a nip together with the heating element; a coil that has a coil hole facing the nip with a gap therebetween and generates the magnetic flux; an induction heating circuit that supplies the coil with a drive signal; an insulating mold that has a through hole facing the coil hole and supports the coil; a mechanism that transports the sheet through the through hole to the nip; and a controller that causes the mechanism to transport the sheet to the nip and the induction heating circuit to perform the induction-heating.

20 Claims, 10 Drawing Sheets

IMAGE FORMING APPARATUS AND CONTROL METHOD

CROSS-REFERENCE TO RELATED APPLICATION

The present application claims priority under 35 U.S.C. 119 to U.S. Provisional Application Ser. No. 61/300,169, entitled FIXING APPARATUS, to DOI, filed on Feb. 1, 2010, the entire disclosure of which is incorporated herein by reference.

FIELD

An embodiment of the present invention relates to an image forming apparatus and a fixing control method.

BACKGROUND

Conventionally, there is known a fixing device in which an induction heating coil is situated in a roller outside a heat roller. A fixing device is known which fixes an image on a sheet using a pair of heat rollers forming a nip and a pair of induction heating coils.

In order to secure the transport path of the sheet, two coils are laid out so that the coil surfaces face a roller outer peripheral surface, respectively. The fixing device should lay out two coils in a place separated from the nip.

For low electric power consumption, it is preferable that the time until the temperature of a belt reaches a fixing temperature is short. The belt starts to run. A belt portion, in which the coil is heated, moves from a rotation upstream of the heat roller to a rotation downstream thereof and approaches the nip.

However, before the warm belt portion reaches the nip, the heat radiates from the belt into the air. The fixing device continues to supply electric power to the coil.

Given the long warming-up time, wastage of electric power occurs. A further short warming-up time is required in the image forming device.

DETAILED DESCRIPTION

Figure 1:
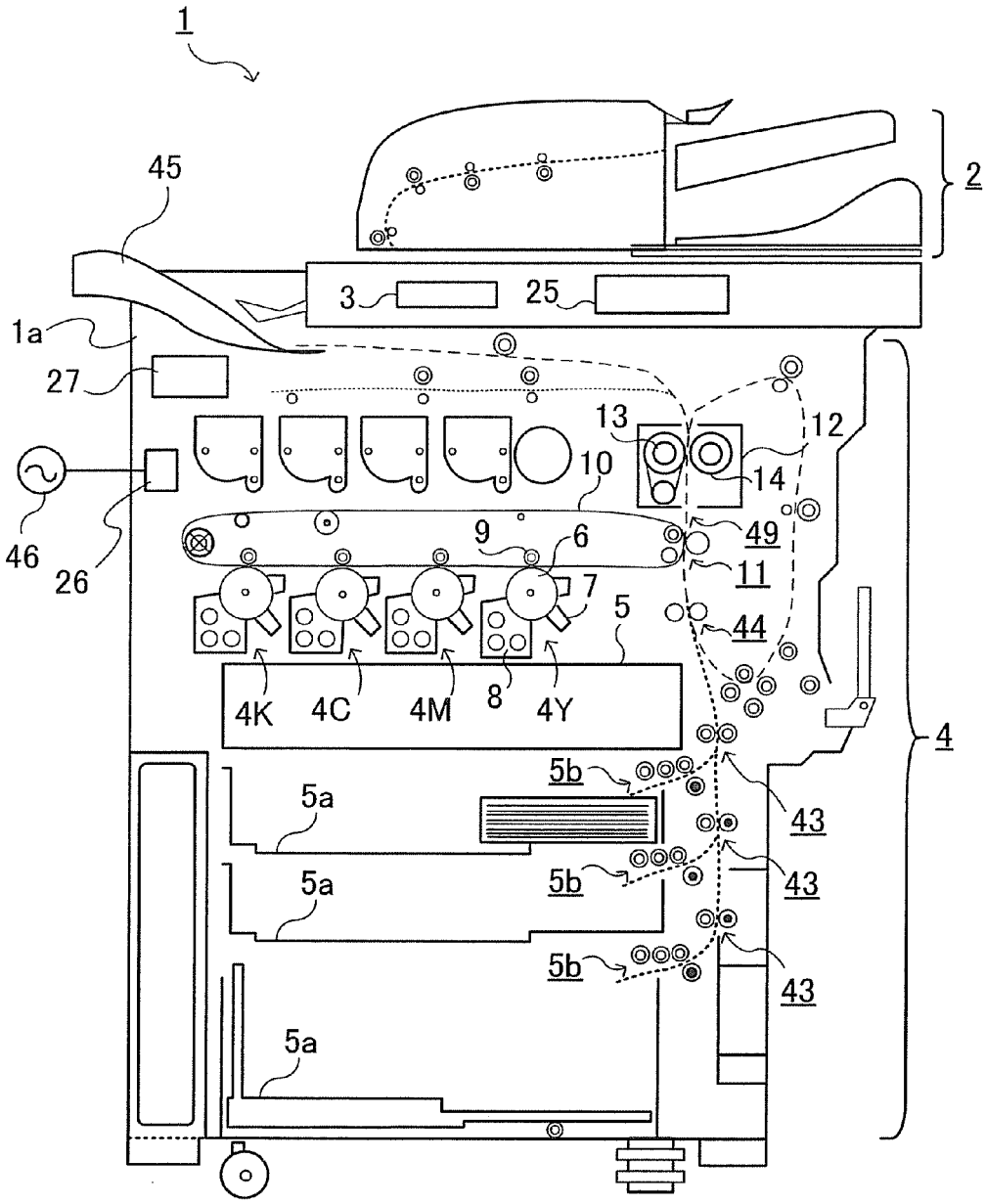
FIG. 1 is a configuration diagram of an image forming device according to an embodiment.

Certain embodiments provide an image forming device, including: a print portion configured to form an as yet unfixed developer image on a sheet; a first roller configured to be provided in a direction in which the sheet from the print portion is transported; a heating element configured to be provided in either the first roller or an endless belt wound around the first roller and generate heat by magnetic flux; a second roller configured to form a nip together with the heating element; a coil configured to have a coil hole facing the nip with a gap therebetween and generate the magnetic flux; an induction heating circuit configured to supply the coil with a drive signal; an insulating mold configured to have a through hole facing the coil hole and support the coil; a mechanism configured to transport the sheet through the through hole of the mold to the nip; and a controller configured to cause the mechanism to transport the sheet to the nip and the induction heating circuit to perform the induction-heating.

Throughout this description, the embodiments and examples shown should be considered as examples, rather than limitations on the apparatus and methods of the present invention.

Hereinafter, an image forming device and a fixing control method will be described in detail with reference to the attached drawings. Furthermore, in the respective drawings, the same portions are denoted by the same reference numerals and the overlapping description will be omitted.

The image forming device according to an embodiment is an MFP (Multi Function Peripheral) having a fixing device by an induction heating scheme.

The fixing control method according to an embodiment is a heating method by a fixing device.

FIG. 1 is a configuration diagram of the MFP. The MFP 1 includes a scanner portion 2 (an image reading portion), an image processing portion 3, and a print portion 4.

The scanner portion 2 scans surfaces of an original document to read an image and converts the read image information to an analog signal.

The image processing portion 3 converts image data of three colors output from the scanner portion 2 to four print color data.

The print portion 4 modulates laser beams of four colors by the four print color data, respectively. The print portion 4 forms a toner image (a developer image) on the sheet.

The MFP 1 has a plurality of cassettes 5*a* in a lower part of the body 1*a*. The MFP 1 has a plurality of roller pairs 5*b* in the entrances to the respective cassettes 5*a*.

The print portion 4 has image forming portions 4Y, 4M, 4C and 4K of yellow (Y), magenta (M), cyan (C), and black (K), and a laser exposure device 5.

The image forming portion 4Y has a photoconductive drum 6, a charger 7, a developing device 8, and a transfer device 9. The photoconductive drum 6 maintains a latent image on the photoconductor. The charger 7 uniformly charges the photoconductive drum 6. The laser exposure device 5 forms the latent image on the photoconductive drum 6.

The developing device 8 develops the latent image on the photoconductive drum 6. The transfer device 9 transfers the toner image on the photoconductive drum 6 to a middle transfer belt 10.

The configurations of the image forming portions 4M, 4C and 4K are substantially identical to the configuration of the image forming portion 4Y.

The print portion 4 includes a secondary transfer member 11 and a fixing device 12. The secondary transfer member 11 has two pairs of rollers. The fixing device 12 nips, heats and pressurizes the sheet, thereby fixing an unfixed image on the sheet.

Figure 2A:
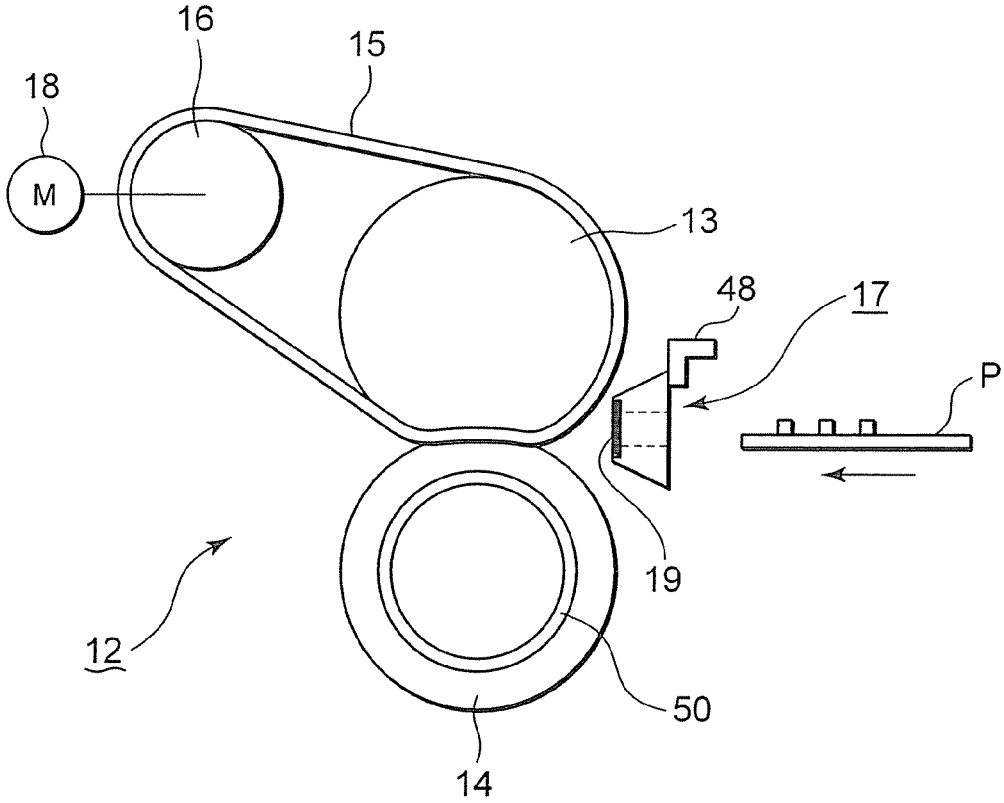
FIG. 2A is a diagram that shows a longitudinal cross-sectional structure of a fixing device used in the image forming device according to an embodiment.

FIG. 2A is a diagram that shows a longitudinal cross-sectional structure of the fixing device 12. The previously mentioned reference numerals indicate the same elements as those.

The fixing device 12 includes a first heat roller (a first roller), a second heat roller 14 (a second roller), a heating belt 15 (a belt), a support roller 16, and a coil unit 17.

The heat roller 13 has a core metal, an elastic layer covering around the core metal, and a release layer. The core metal is a shaft body. The elastic layer is a layer of a synthetic resin. The release layer is a surface coming into contact with the sheet.

The heat roller 14 has a core metal, an elastic layer, a release layer, and a heating layer 50. The heating layer 50 rotates in conjunction with the rotation of the core metal. The heating layer 50 is provided, for example, between the metal core and the elastic layer.

The outer peripheral surface of the heat roller 13 and the outer peripheral surface of the heat roller 14 form a nip.

The heating belt 15 is an endless belt.

The support roller 16 causes the heating belt 15 to run. The outer peripheral surface of the support roller 16 comes into close contact with the inner peripheral surface of the heating belt 15. The support roller 16 is rotated by a motor 18.

The coil unit 17 generates the magnetic flux. An eddy current is generated in the conductive heating layer of the heating belt 15.

Figure 2B:
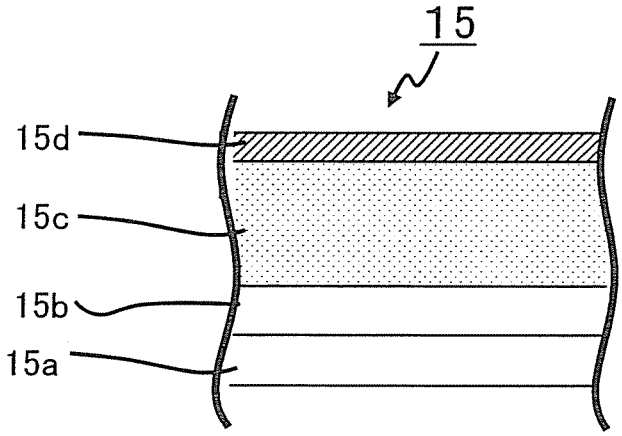
FIG. 2B is a diagram that shows an example of a longitudinal cross-sectional structure of a belt having a heating element used in the image forming device according to an embodiment.

FIG. 2B is a diagram that shows an example of a longitudinal cross-sectional structure of the heating belt 15. The heating belt 15 has a base material 15*a*, a heating layer 15*b* (a first heating layer), an elastic layer 15*c*, and a release layer 15*d* from the inside toward the outside.

The base material 15*a* has the heating belt 15 rigidity. The material of the base material 15*a* is a heat-resistant synthetic resin.

The heating layer 15*b* generates Joule heating by resistance. The heating layer 15*b* is formed of a conductive material. The heating layer 15*b* is, for example, a metal such as stainless steel.

The elastic layer 15*c* equalizes the density of the image on the sheet. The material of the elastic layer 15*c* is a silicon sponge.

The release layer 15*d* has heat resistance. The material of the release layer 15*d* is a fluororesin.

Figure 3A:
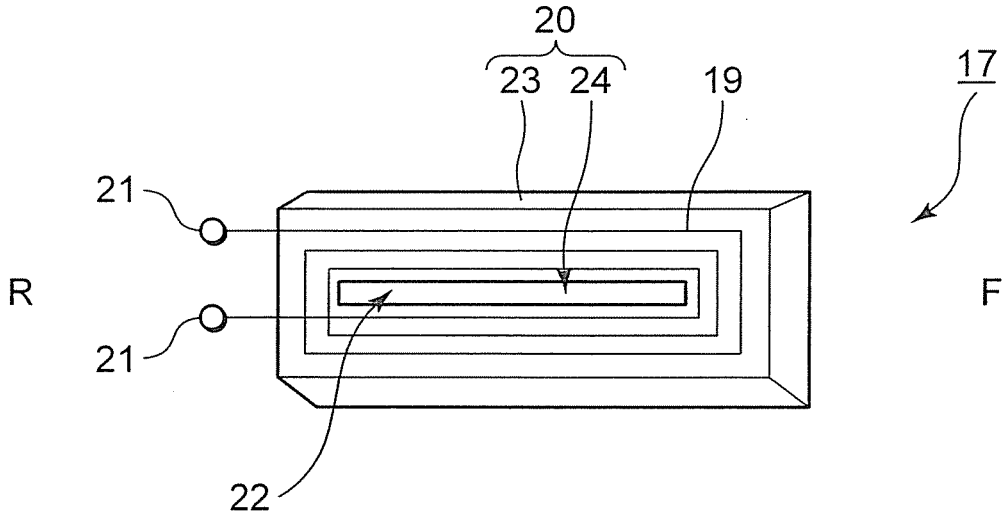
FIG. 3A is a perspective view of a coil unit that includes a coil and a mold used in the image forming device according to an embodiment.
Figure 3B:
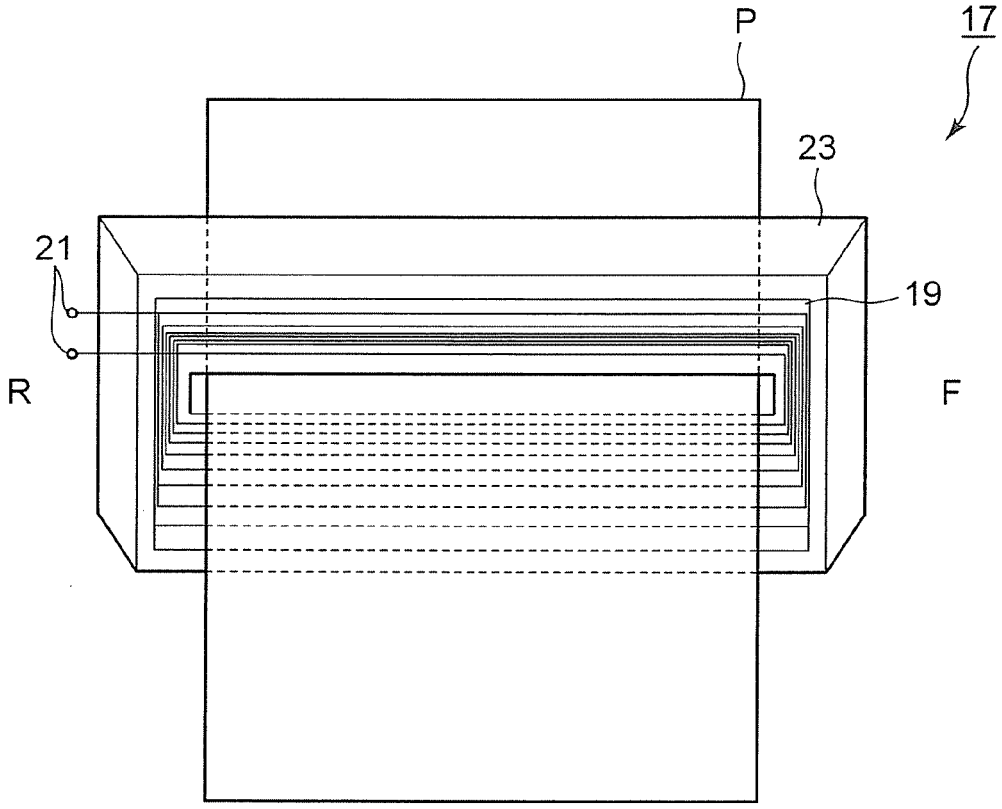
FIG. 3B is a perspective view from above of a coil unit in which a sheet passes through a through hole.

FIG. 3A is a perspective view of the coil unit 17. FIG. 3B is a perspective view from above of the coil unit 17 in which a sheet P passes through a through hole 24. The previously mentioned reference numerals indicate the same elements as the above-mentioned elements. The left and right in FIGS. 3A and 3B are front sides and rear sides of the body 1*a*, respectively.

The coil unit 17 includes a coil (an induction heating coil) 19 as an induction heating coil, and a mold case 20 molded with a synthetic resin.

The coil 19 uses a litz wire. The litz wire uses a plurality of twisted line materials each of which is individually insulated. The litz wire gathers scores of line materials to hundreds of line materials. The line material is formed of copper. A diameter of the line material is smaller than a penetration depth in a high frequency.

The line material is covered with the synthetic resin. The synthetic resin has an insulating property and heat resistance. The coil 19 has electrodes 21 in both ends of the coil 19. The coil 19 has a coil hole 22.

The mold case 20 has an insulating property and heat resistance. The mold case 20 has a main body case 23 and a through hole 24 having flat surfaces. The main body case 23 is fixed in the fixing device 12. The through hole 24 is situated in the middle of a surface of the main body case 23.

The through hole 24 has a hole length, a hole width, and a hole depth. The hole length refers to the size in the left to right direction of FIG. 3A. The hole width refers to the size in a vertical direction of FIG. 3A. The hole depth is substantially the same as the case thickness of the main body case 23.

The coil 19 and the mold case 20 are integrated with each other. An opening of the through hole 24 is overlapped with the coil hole 22. The fixing device 12 transports the sheet from the rear part of the main body case 23. The coil unit 17 passes the sheet through the coil hole 22 and the through hole 24.

The hole length of the through hole 24 is larger than the sheet width of the sheet. The hole width of the through hole 24 is larger than the sheet thickness of the sheet. The hole width has a size of an extent that does not disrupt the transportation of the sheet.

The shape and size of the coil hole 22, and the shape and the size of the through hole 24 are decided by the sheet width or the sheet length of the sheet.

The fixing device 12 has a holder 48 of an insulation material that maintains the coil unit 17 as shown in FIG. 2A. The holder 48 is fixed to an inner wall of a container.

The holder 48 maintains the coil unit 17 in the middle between the heat rollers 13 and 14 in a height direction. The holder 48 causes the coil surface of the coil 19 to face a nip portion between the heat rollers 13 and 14.

The holder 48 maintains the coil unit 17 so that a clearance of a gap between the coil 19 and the nip portion expanded by the heat is within a predetermined range.

The coil unit 17 may have an insulation material and a magnetic substance core.

The MFP 1 of FIG. 1 has a main control unit 25 (a controller), a power supply unit 26, and an electric substrate 27.

The main control unit 25 controls the whole MFP 1. The main control unit 25 generates a printing job and handles the printing job to the print portion 4.

The main control unit 25 has a ROM (read only memory), RAM (random access memory), and CPU (central processing unit).

The fixing device 12 works in a plurality of modes having target temperatures different from each other. The main control unit 25 selects any one mode among the plurality of modes, thereby assigning the mode to the MPF 1.

The main control unit 25 reads the electric power level information corresponding to the target temperature from the ROM, and outputs the level information to the fixing device 12. The main control unit 25 controls the time at which the electric current is applied to the coil 19.

The power supply unit 26 converts the electric power from a commercial alternating current powers source 46 to a plurality of direct current voltages having different levels.

Figure 4A:
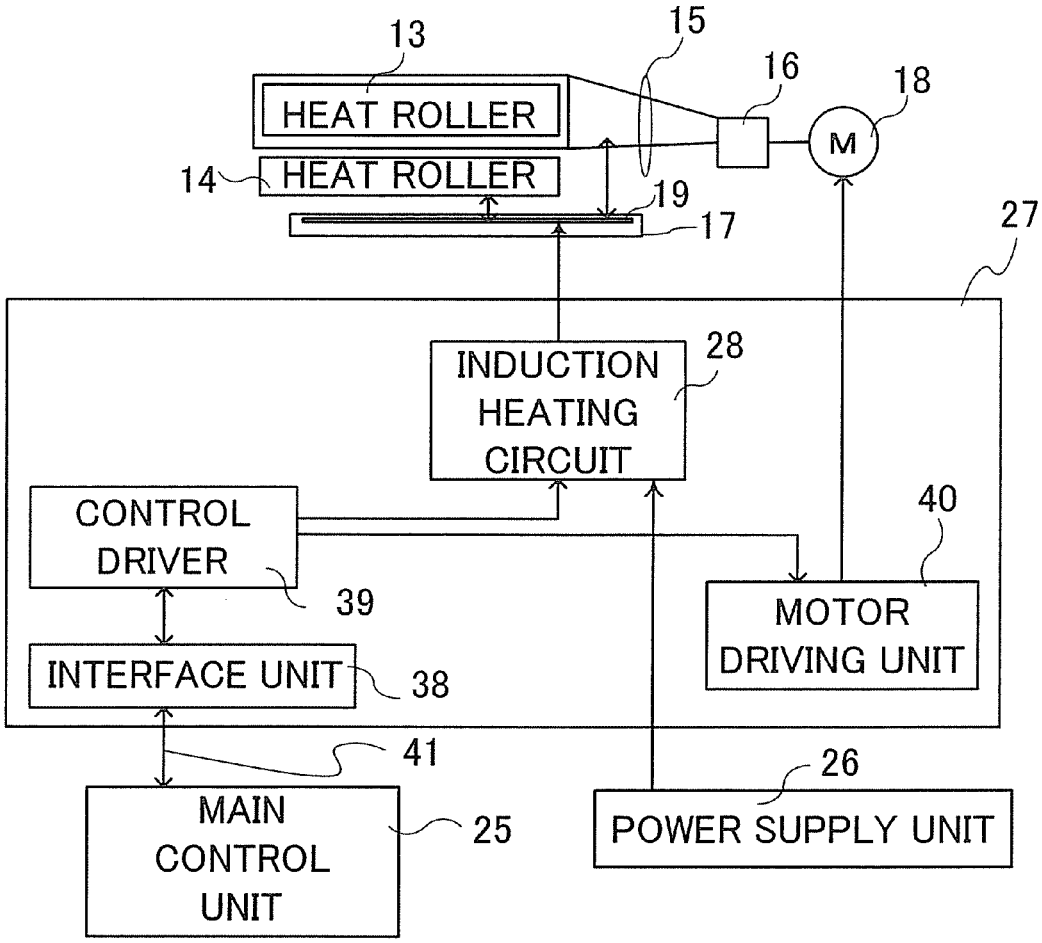
FIG. 4A is a block diagram of a circuit on an electric substrate that is used in the image forming device according to an embodiment.

FIG. 4A is a block diagram of a circuit on an electric substrate 27. The previously mentioned reference numerals indicate the same elements as the above-mentioned elements.

The electric substrate 27 includes an induction heating circuit 28. The induction heating circuit 28 adds the high frequency current to the coil unit 17. The induction heating circuit 28 supplies the direct current voltage from the power supply unit 26 to the coil unit 17.

The main control unit 25 causes a mechanism, as described herein below, to transport the sheet to the nip. The main control unit 25 causes the induction heating circuit 28 to perform the induction-heating.

Figure 4B:
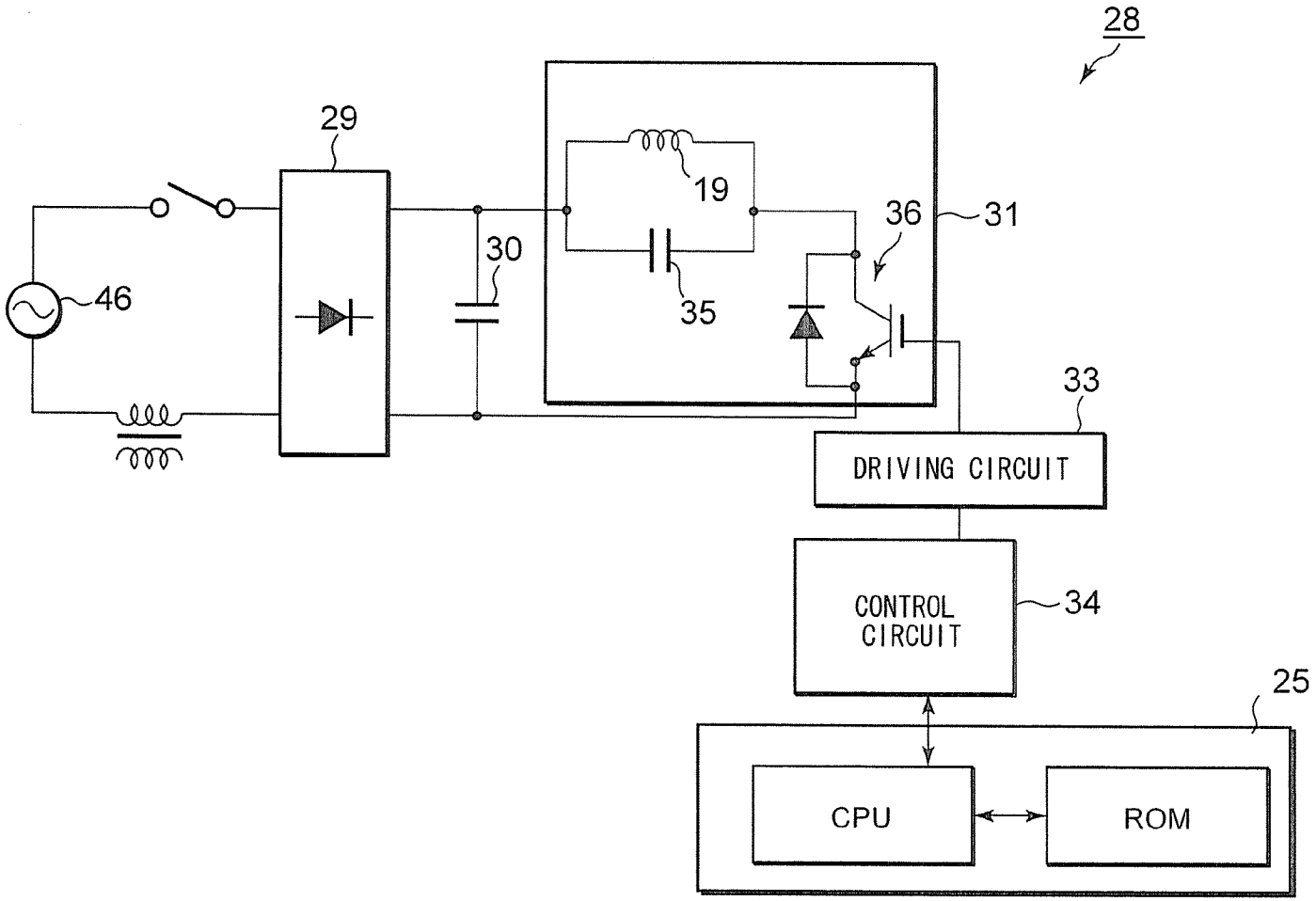
FIG. 4B is a block diagram of an induction heating circuit that is used in the image forming device according to an embodiment.

FIG. 4B is a block diagram of an induction heating circuit 28. The previously mentioned reference numerals indicate the same elements as the above-mentioned elements. The induction heating circuit 28 includes a rectification circuit 29, a capacitor 30, an inverter circuit 31, a driving circuit 33, and a control circuit 34.

The rectification circuit 29 rectifies the alternating current from the commercial alternating current power source 46. The capacitor 30 smoothes the output of the rectification circuit 29. The capacitor 30 supplies the inverter circuit 31 with the direct current electric power.

The inverter circuit 31 includes a coil 19, a capacitor 35 and a switching element 36. The capacitor 35 is connected to the coil 19 in parallel.

The switching element 36 is connected to the parallel circuit, which makes the coil 19 and the capacitor 35 a pair, in series.

In a resonance frequency of the signal that is outputted from the switching element 36, the capacitor 35 and the coil 19 resonate.

The driving circuit 33 is connected to the control terminal of the switching element 36. The control circuit 34 modulates the electric current by the pulse width. The driving circuit 33 turns on and off the switching element 36 by the drive voltage.

The control circuit 34 controls the on time length and the off time length, whereby the amount of the heating of the heating belt 15 is changed.

As shown in FIG. 4A, the main control unit 25 outputs the control signal to the induction heating circuit 28 including the control circuit 34.

The electric substrate 27 includes an interface unit 38, a control driver 39, and motor driving unit 40. The interface unit 38 transmits and receives the signal to and from the main control unit 25 via the signal line 41.

The control driver 39 inputs and outputs the control signal between the interface unit 38, the induction heating circuit 28, and the motor driving unit 40. The motor driving unit 40 drives the motor 18.

Returning to FIG. 1, the MFP 1 has a plurality of roller pairs 43 in a lower part of the body 1*a*. The respective roller pairs 43 separate one sheet and transports one sheet. The roller pairs 44 correct the skew of the sheet. The roller pair 44 guides the sheet to the print portion 4.

The respective nips of the roller pairs 5*b*, 43 and 44, the secondary transfer member 11, the fixing device 12, and the guide between the secondary transfer member 11 and the fixing device 12 define the transformation path 49 of the sheet. The motor that rotates the roller pairs 5*b*, 43 and 44, respectively, the roller pairs in the secondary transfer member 11, the heat rollers 13 and 14, the heating belt 15, and the support roller 16 constitute one sheet transport mechanism (a mechanism).

The fixing control method by the main control unit 25 of the MFP 1 having the above-mentioned configuration will be described.

Figure 5:
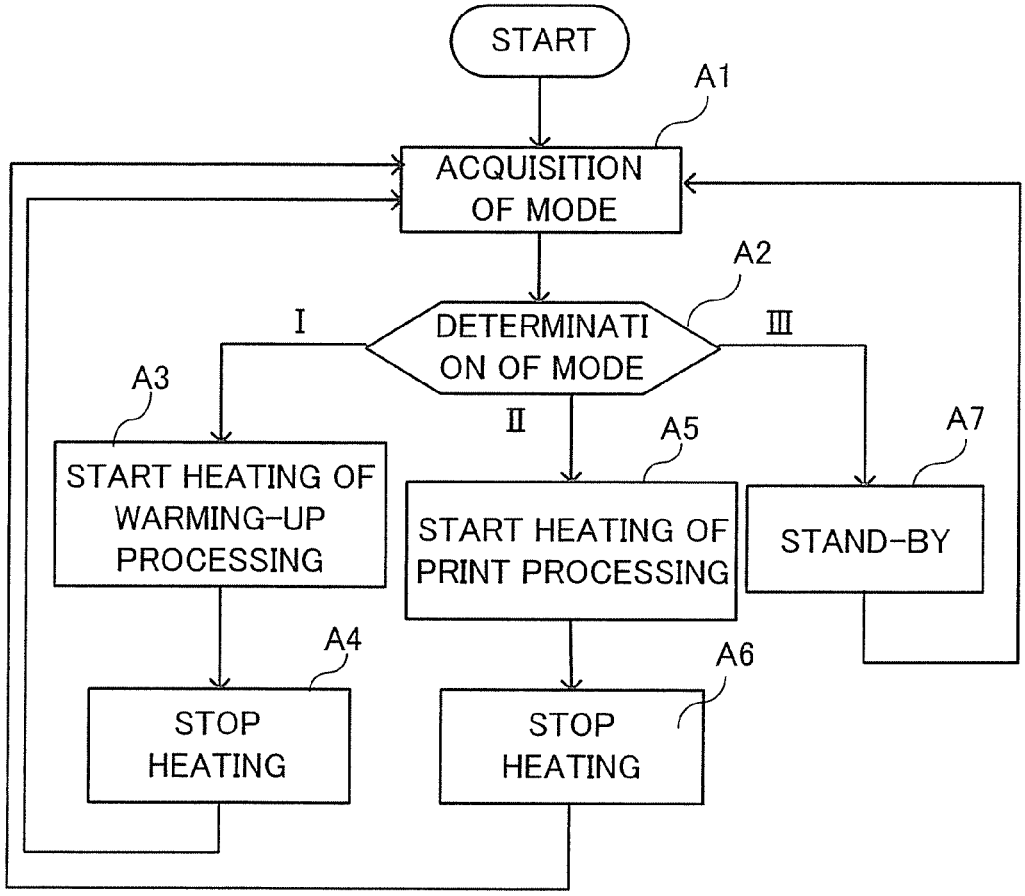
FIG. 5 is a flow chart for explaining a heating control method according to an embodiment.

FIG. 5 is a flow chart for explaining a heating control method of the fixing device 12.

The MPF 1 is powered on.

The main control unit 25 in Act A1 reads the mode information of the MFP 1.

The main control unit 25 in Act A2 determines the mode by the mode information. For example, the main control unit 25 determines that the mode is any one of the print mode, the warming-up mode, or the ready mode.

The print mode refers to a mode in which the MFP 1 drives an image forming process and the temperature of the fixing device 12 is a fixing temperature. The warming-up mode refers to a middlemost mode in which the temperature of the fixing device 12 is raised up to the fixing temperature. The ready mode refers to a mode in which the MFP 1 can directly start the image forming process and the temperature of the fixing device 12 is the fixing temperature.

In Act A2, when the main control unit 25 determines that the mode is the warming-up mode, the main control unit 25 starts the processing of the warming-up through a route indicated by I in ACT A3.

Specifically, the main control unit 25 instructs the electric substrate 27 to rotate. The main control unit 25 notifies the electric power level information to the electric substrate 27. The heating belt 15 begins to rotate. The induction heating circuit 28 drives the coil unit 17, for example, in the electric power of 900 W.

Figure 6:
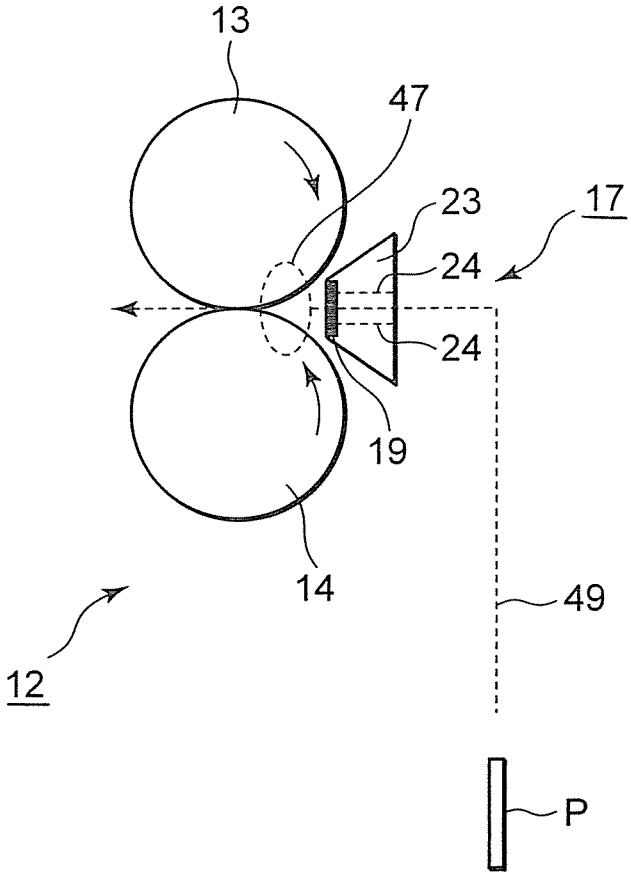
FIG. 6 is a diagram that shows a portion heated by a fixing device which is used in the image forming device according to an embodiment.

FIG. 6 is a diagram that shows a portion heated by the fixing device 12. The previously mentioned reference numerals indicate the same elements as the above-mentioned elements.

The nip portion 47 begins to heat between the heating belt 15 and the heat roller 14 during rotation.

The nip portion 47 refers to an area where the heating layer 15*b* of the heating belt 15 comes into contact with the heating layer 50 of the heat roller 14.

The magnetic flux leaks to both of the heating layers 15*b* and 50. The eddy current is generated on the surfaces of the heating layers 15*b* and 50, thereby cancelling the magnetic flux. The eddy current and the resistance generate Joule heating. The heating layers 15*b* and 50 are heated. The nip portion 47 facing the coil surface of a spiral shape is heated.

The sheet P is transported along the transport path 49.

The induction heating circuit 28 applies the electric current having a suitable driving frequency to the coil unit 17 with respect to the clearance of the gap between the coil 19 and the nip portion 47. The expression, "suitable" means effective from the viewpoint of the conversion efficiency of the induction heating circuit 28.

The main control unit 25 detects that the temperature of the fixing device 12 reaches a desired value, for example, by the output of the temperature sensor or the like. In Act A4 of FIG. 5, the main control unit 25 stops the heating driving. The control returns to Act A1.

As a result, only the nip portion 47 to be heated is heated. Wasted radiation is not generated. The heating is performed only for the necessary time. The warming-up time can be reduced.

The MFP 1 can rapidly raise the temperature of the fixing device 12 from a state without a thermal history to the temperature necessary for fixing.

Furthermore, in Act A1, the main control unit 25 reads the mode information of MFP 1.

The original document is inserted into the scanner portion 2. The print job is generated in the MFP 1.

In Act A2, when the main control unit 25 determines that the mode is the print mode, in Act A5, the main control unit 25 starts the print processing through the route indicated by II.

The main control unit 25 drives the print portion 4. The roller pair 5*b* picks up the sheet from the cassette 5*a*. The roller pair 43 transports the sheet from the lower part to the upper part.

The print portion 4 forms the electrostatic latent images on four photoconductive surfaces based on the image data of the scanner portion 2. The respective developers 8 stir the toner. The respective developers 8 supply the respective photoconductive drums 6 on which the electrostatic latent images are formed with the toner. The electrostatic latent images on the respective photoconductive drums 6 become visible.

The middle transfer belt 10 transfers the toner images of four colors onto the belt surface. The secondary transfer member 11 transfers the respective toner images on the middle transfer belt 10 onto the sheet.

The secondary transfer member 11 makes the sheet just before the fixing device 12 wait.

The main control unit 25 notifies the control signal to the electric substrate 27.

The main control unit 25 starts the rotation of the motor of the secondary transfer member 11, thereby transporting the sheet to the nip portion 47.

At the timing when the sheet reaches the nip portion 47, the coil 19 creates a magnetic field having the electric power of, for example, 700 to 1,500 W. The heating layer 15*b* of the heating belt 15 and the heating layer 50 of the heat roller 14 are heated.

In the coil unit 17 of the fixing device 12, the sheet is transported through the coil hole 22 of the coil 19 and the through hole 24 of the mold case 20. The sheet has an insulating property. The passing of the sheet does not affect the magnetic property of the coil 19.

The fixing device 12 fixes the toner images of four colors on the sheet. The MFP 1 gathers the sheet output by the fixing device 12 in the discharge tray 45.

The sheet may be displaced. The through hole 24 is of a sufficient size not to disturb the progression of the sheet, even with respect to the displacement in the vertical direction and the left to right direction of the sheet.

Since the unfixed toner image does not come into contact with the coil unit 17, the unfixed toner image does not affect the image. Even if the unfixed toner image comes into contact with the edge of the hole width of the through hole 24, the image is not scattered.

The main control unit 25 ends the print job. The control by the main control unit 25 returns to the processing of Act A1 of FIG. 5.

After the print out, the main control unit 25 transits the mode of the MFP 1 to the ready mode through a time out or the like.

In Act A1, the main control unit 25 reads the mode of the MFP 1. When the main control unit 25 determines that the mode is the ready mode, the main control unit 25 is shifted to the stand-by state through a route indicated by III in Act A7.

In this manner, the fixing device 12 transports the sheet to the center portion of the coil 19. The transport path of the sheet can be secured. The direct heating of the nip portion is realized. The MFP 1 realizes to heat only the nip portion that most essentially needs heating.

The portion to be heated is substantially identical to the portion to which the toner image is fixed. The fixing device 12 can raise the temperature up to the fixing temperature during a shorter warming-up time. For this reason, The MFP 1 can suppress heat from wastefully radiating into the air.

Figure 7A:
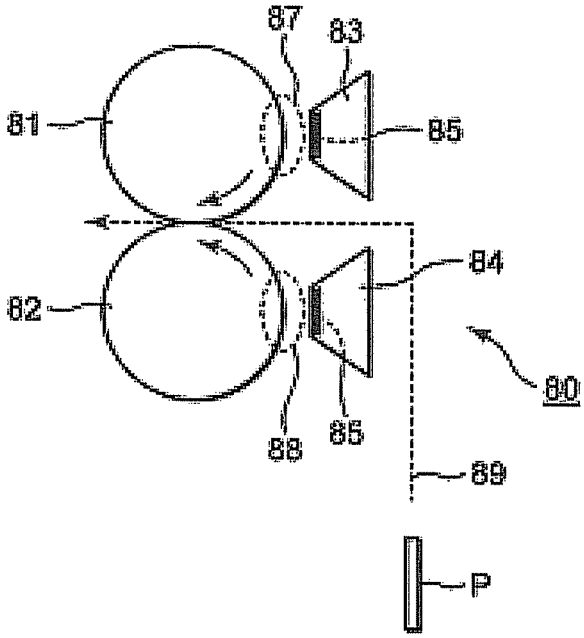
Related Art FIG. 7A
FIG. 7A is a diagram that shows a configuration example of a fixing device according to the related art.

FIG. 7A is a diagram that shows a configuration example of a fixing device according to the related art.

A fixing device 80 includes heat rollers 81 and 82, a coil unit 83 of a side part of an outer periphery of the heat roller 81, and a coil unit 84 of a side part of an outer periphery of the heat roller 82. The coil units 83 and 84 are for induction heating.

The heat rollers 81 and 82 have heating layers. The heat roller 81 is, for example, driven by the belt. The heat roller 82 is driven accordingly.

Figure 7B:
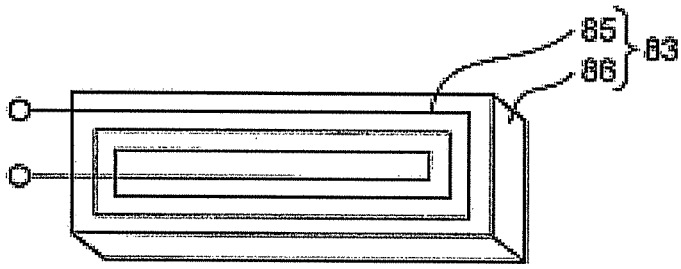
Related Art FIG. 7B
FIG. 7B is a perspective view of a coil unit of a fixing device of the related art.

FIG. 7B is a perspective view of the coil unit 83. The coil unit 83 has a coil 85 and a holeless mold case 86. The coil unit 84 is substantially identical to the coil unit 83.

As shown in FIG. 7A, the heat roller 81 starts to rotate. A portion facing the coil unit 83 of the heat roller 81 is heated by the coil 85. The heated portion 87 (i.e., a heating element on the roller or the belt) starts to rotate clockwise.

The portion of the heat roller 82 facing the coil unit 84 is heated by the coil 85. The heated portion 88 starts to rotate counterclockwise. The sheet P is transported along the transport path 89.

The portions 87 and 88 form a nip portion. The heat rollers 81 and 82 fix the toner image.

The fixing device 80 needs to secure a space, in which the sheet is transported, between the coil units 83 and 84 so as to lay out two coils 85. The fixing device 80 should lay out two coils 85 in a place separated from the nip portion.

In the nip portion, there is a need to shorten the time until the temperatures of the heating element and the belt reach the fixing temperature. By the rotation of the heat rollers 81 and 82, the heated portions 87 and 88 are moved from the upstream to the downstream in a rotation direction toward the nip portion.

However, the temperatures of the portions 87 and 88 during movement decline. The positions facing the coil units 83 and 84 respectively are positions of the upstream side separated from the nip portion. The fixing device 80 is necessary to locate the transport path 89 between two coil units 83 and 84. The fixing device 80 has the limitation of the lay-out of the coil element.

Through the limitation on the lay-out of the two coil units 83 and 84, the fixing device 80 needs to heat the temperature of the portions 87 and 88 to a slightly higher temperature.

Generally, an induction heating coil is formed by winding the litz wire in a circular pattern. In the fixing device 80, since the coil 85 is surrounded by the mold case 86, a hole is not formed in the center portion of the mold case 86.

On the contrary to this, in the MFP 1, the center portion of the through hole 24 is used in the transportation of the sheet. The fixing device 12 is able to dispose the induction heating coil (a coil 19) in a position where the fixing device 80 according to the related art cannot dispose the induction heating coil.

The fixing device 12 can heat just the portion between the heat rollers 13 and 14 which requires heating. The fixing device 12 can directly heat the nip portion. Since the radiation amount is none or can be minimized, waste of electric power consumption is suppressed.

The warming-up time can be reduced. The number of sheets, which can be printed and output, is improved. Productivity is improved.

Furthermore, the fixing device 80 according to the related art heats two heat rollers 81 and 82, respectively, using two coils 85 for induction heating. Fixing device 80 requires two sets of the coil 85 and the induction heating circuit.

The MFP 1 according to the present invention heats two heat rollers 13 and 14 by one coil unit 17. For this reason, the fixing configuration can be simplified. The lower cost of the product is promoted.

As mentioned above, according to the MFP 1, space conservation is achieved and reduction of the warming-up time of the IH fixing method is promoted. According to the MFP 1, the similar amount of the heat created in the related art is obtained, so that electric power consumption can be reduced.

The configuration of the coil unit 17 is an example. The material of the synthetic resin of the mold case 20, and the shape and the size of the through hole 24 can be variously modified or changed. Even with respect to invention which is a mere modified embodiment of the example of FIG. 3, the superiority of the image forming device according to the present embodiment does not deteriorate.

The fixing configuration of the fixing device 12 can be variously changed.

In the above-mentioned embodiment, the heating element is provided on the heating belt 15, but the first heat roller 13 may have another heating element (a second heating layer) as the heating element, instead of the heating belt 15. The motor drives the heat rollers 13 and 14, respectively.

Otherwise, another heating belt may be wound around the heat roller 14, so that the motor drives the heating belt.

While certain embodiments have been described, these embodiments have been presented by way of example only, and are not intended to limit the scope of the inventions. Indeed, the novel methods and apparatus described herein may be embodied in a variety of other forms; furthermore various omissions and substitutions and changes in the form of methods and systems described herein may be made without departing from the spirit of the inventions. The accompanying claims and their equivalents are intended to cover such forms or modifications as would fall within the scope and spirits of the inventions.

What is claimed is:

1. An image forming device comprising:

a print portion configured to form an as yet unfixed developer image on a sheet;

a first roller configured to be provided in a direction in which the sheet from the print portion is transported;

a heating element configured to be provided in either the first roller or an endless belt wound around the first roller and generate heat by magnetic flux;

a second roller configured to form a nip together with the heating element;

a coil configured to have a coil hole facing the nip with a gap therebetween and operable of generating the magnetic flux;

an induction heating circuit configured to supply the coil with a drive signal;

an electrically insulating mold configured to have a through hole facing the coil hole and operable of supporting the coil, the mold causing the coil to face a coil surface to the nip;

a mechanism configured to transport the sheet through the through hole of the mold and the coil hole of the coil to the nip; and a controller configured to cause the mechanism to transport the sheet to the nip and the induction heating circuit to perform the induction-heating.

2. The device of claim 1, wherein, the coil situates the coil hole in a center portion of a spiral of the coil and the mechanism transports the sheet from the through hole to the center portion.

3. The device of claim 1, wherein, the heating element is a first heating layer of a belt side or a second heating layer of an outer peripheral surface side of the first roller, and the coil radiates the magnetic flux to only a portion of the first heating layer or the second heating layer near the gap to be heated.

4. The device of claim 3, wherein, the coil reduces amount of heat which is radiated from a portion different from the portion of the first heating layer or the second heating layer to be heated.

5. The device of claim 1, wherein, the mold has heat-resistance.

6. The device of claim 1, wherein, the mold has a main body case having the through hole; and a surface in which the through hole is situated in a middle part of the main body case.

7. The device of claim 1, wherein, the coil and the mold are integrated with each other.

8. The device of claim 1, wherein, a hole length of the through hole is greater than a width of the sheet.

9. The device of claim 1, wherein, a width of the through hole is greater than a thickness of the sheet.

10. The device of claim 1, wherein, a hole width of the through hole has a size of an extent that does not disturb the transportation of the sheet.

11. The device of claim 1, wherein, the heating element is a first heating layer of a belt side, and the heating layer is moved from an upstream to a downstream in a running direction in conjunction with the running of the belt.

12. The device of claim 1, wherein, the heating element is a second heating layer of an outer peripheral surface side of the first roller, and the heating layer is moved from an upstream to a downstream in a rotation direction in conjunction with rotation of the first roller.

13. A fixing control method, comprising the steps of:

setting an electric power level with respect to an induction heating circuit which supplies a coil generating a magnetic flux with a driving signal;

transporting a sheet with an as yet unfixed developer image thereon, thereby passing the sheet through a through hole of an electrically insulating mold supporting the coil that faces a coil hole of the coil, the mold causing the coil to face a coil surface to the nip;

transporting the sheet from the through hole and the coil hole of the coil toward a nip that is formed between a pair of rollers; and heating a heating element that is provided in any one of a first roller among the pair of rollers and an endless belt wound around the first roller.

14. The method of claim 13, wherein, in the step of passing the sheet, the sheet is passed through the through hole having a hole length that is greater than a sheet width of the sheet.

15. The method of claim 13, wherein, in the step of passing the sheet, the sheet is passed to the through hole having a hole width that is greater than a sheet thickness of the sheet.

16. The method of claim 13, wherein, in the step of passing the sheet, the sheet is passed to the through hole having a size of an extent that a hole width does not disturb the transportation of the sheet.

17. The method of claim 13, wherein, in the step of passing the sheet, the through hole is installed in a middle portion of a surface of a main body case that constitutes the mold; and the sheet is passed to the through hole.

18. The method of claim 13, wherein, in the step of transporting the sheet, the sheet is transported from the through hole and the coil hole facing the nip with a gap therebetween to the nip.

19. The method of claim 13, wherein, in the step of heating the heating element, the first heating layer of a belt side as the heating element is moved from an upstream to a downstream in a running direction of the belt, and the heating layer is heated in the nip.

20. The method of claim 13, wherein, in the step of heating the heating element, the second heating layer of an outer peripheral surface side of the first roller as the heating element is moved from an upstream to a downstream in a rotation direction of the first roller, and the heating layer is heated in the nip.

* * * * *